US010990041B2

(12) United States Patent
Velner et al.

(10) Patent No.: US 10,990,041 B2
(45) Date of Patent: Apr. 27, 2021

(54) ADJUSTING POSITIONS OF IMAGES

(71) Applicant: HP INDIGO B.V., Amstelveen (NL)

(72) Inventors: Eli Velner, Ness Ziona (IL); Gilad Greenberg, Ness Ziona (IL); Bar-Navi Miki, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/603,798

(22) PCT Filed: Apr. 13, 2017

(86) PCT No.: PCT/EP2017/059040
§ 371 (c)(1),
(2) Date: Oct. 8, 2019

(87) PCT Pub. No.: WO2018/188760
PCT Pub. Date: Oct. 18, 2018

(65) Prior Publication Data

US 2020/0133168 A1 Apr. 30, 2020

(51) Int. Cl.
*G03G 15/16* (2006.01)
*G03G 15/23* (2006.01)

(52) U.S. Cl.
CPC ..... *G03G 15/161* (2013.01); *G03G 15/1605* (2013.01); *G03G 15/237* (2013.01);
(Continued)

(58) Field of Classification Search
CPC ..... G03G 15/161; G03G 2215/0429; G03G 2215/00223; G03G 2215/00455; G03G 2215/0089; G03G 15/1605; G03G 15/237
See application file for complete search history.

(56) References Cited

U.S. PATENT DOCUMENTS 5,999,763 A 12/1999 Hiroshima et al.
6,263,174 B1 7/2001 Fuchiwaki et al.
(Continued)

FOREIGN PATENT DOCUMENTS

EP 1907904 4/2008
EP 2153283 2/2010

OTHER PUBLICATIONS

Lithography-Blankets, 2001, Available at: <http://magazine-printer.com/printing-process-explained/lithography-files/blankets.html >.

*Primary Examiner* — Ryan D Walsh
(74) *Attorney, Agent, or Firm* — Brooks Cameron & Huebsch PLLC

(57) ABSTRACT

According to some examples, a method comprises successively transferring a series of images from an imaging surface to an intermediate transfer member, ITM, then from the ITM to positions on a web substrate. The method may comprise intermittently adjusting a position at which particular images are transferred to the ITM by a first defined distance laterally across the ITM and by a second defined distance longitudinally with respect to the ITM. The method may comprise adjusting a position at which the particular images are transferred to the web substrate by approximately the first defined distance laterally relative to the ITM and by approximately the second defined distance longitudinally relative to the ITM. The method may comprise, after a first defined number of intermittent position adjustments, changing a direction in which the position is adjusted. A print apparatus and a machine-readable medium are also disclosed.

14 Claims, 3 Drawing Sheets

(52) U.S. Cl.
CPC ..... *G03G 2215/0089* (2013.01); *G03G 2215/00223* (2013.01); *G03G 2215/00455* (2013.01); *G03G 2215/0429* (2013.01)

(56) References Cited

U.S. PATENT DOCUMENTS

| | | | | |
|---|---|---|---|---|
| 7,150,572 | B2 | 12/2006 | McNestry et al. | |
| 7,937,010 | B2 | 5/2011 | Yacoub et al. | |
| 2008/0245248 | A1 | 10/2008 | Takamatsu | |
| 2009/0080922 | A1* | 3/2009 | Yacoub ..... | G03G 15/10 399/66 |
| 2012/0318154 | A1 | 12/2012 | Muraoka | |

* cited by examiner

ADJUSTING POSITIONS OF IMAGES

BACKGROUND

In the field of printing, liquid electrophotography (LEP) technology may be implemented. LEP printing may involve the transfer of electrically-charged liquid ink via a series of rollers to a substrate.

BRIEF DESCRIPTION OF DRAWINGS

Examples will now be described, by way of non-limiting example, with reference to the accompanying drawings, in which.

DETAILED DESCRIPTION

In a liquid electrophotography (LEP) printing system, print agent, such as ink, is stored in a binary ink developer (BID). Each BID stores print agent of a particular colour, so an LEP printing system may include, for example, seven BIDs. Print agent from a BID is selectively transferred from a developer roller of the BID in a layer of substantially uniform thickness to a photo imaging plate (PIP). The selective transfer of print agent may be achieved through the use of electrically-charged print agent. The entire PIP may be charged, then areas representing an image to be printed may be discharged, for example by forming a latent image on the PIP using a laser beam. Print agent is transferred to those portions of the PIP that have been discharged. The PIP may transfer the print agent to an intermediate transfer member (ITM) which may be covered by a replaceable print blanket. The print agent may subsequently be transferred onto a printable substrate, such as paper. In some examples, the printable substrate may be a web substrate, such as a length of printable material stored on a roll.

Figure 1:
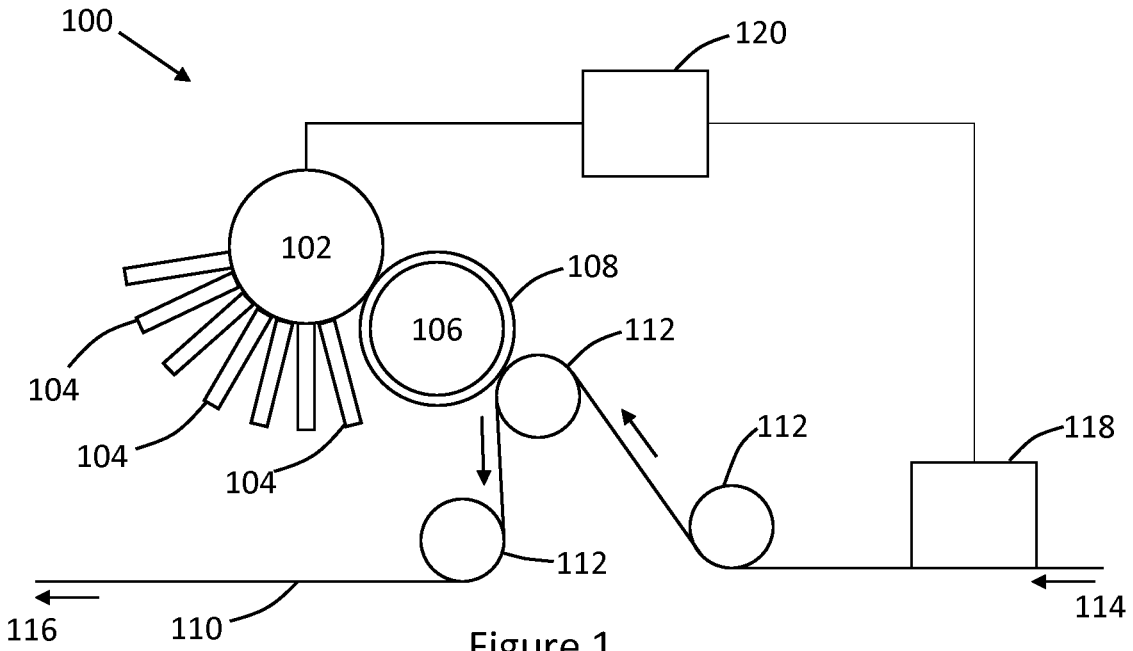
FIG. 1 is a simplified schematic of an example of print apparatus.

Referring to the drawings, FIG. 1 shows a simplified, schematic illustration of an example apparatus, such as a print apparatus 100. The print apparatus 100 may be an LEP print apparatus. The apparatus 100 includes an imaging plate 102, such as a photographic imaging plate (PIP). The imaging plate 102 may, in some examples, comprise a substantially cylindrical roller. In some examples, the imaging plate 102 may formed on a drum. In some examples, the imaging plate 102 may formed on a belt. Binary ink developers (BIDs) 104 are arranged around the imaging plate 102 and may be arranged such that a developer roller (not shown) in each BID is able to interact (i.e. transfer print agent to) the imaging plate. In the example shown, the print apparatus 100 includes seven BIDs 104 and each BID may store and transfer print agent of a particular colour. In other examples, more or fewer BIDs 104 may be included.

The apparatus 100 further includes an intermediate transfer member (ITM) 106. The ITM 106 may, in some examples, comprise a substantially cylindrical roller. The ITM 106 may include a print blanket 108 which, in some examples, may be replaceable. In other words, it may be intended that the print blanket 108 is replaced by a new print blanket after a defined time or after a defined number of uses. The print blanket 108 may, in some examples, comprise a flexible sheet wrapped and secured around the ITM 106, so as to receive print agent from the imaging plate 102.

A printable substrate 110, such as paper, for example, is brought into contact with the ITM 106. In some examples, the substrate 110 may be fed through a series of rollers 112. The substrate 110 may, in some examples, comprise a web substrate. The web substrate 110 may comprise a length of material onto which print agent may be transferred. The web substrate 110, which in some examples may be stored on a roll, may be fed into the print apparatus 100 from an inlet end 114, pass through the apparatus via the rollers 112, and exit the apparatus at an outlet end 116. The web substrate, in the example shown, is fed in the direction of the arrows. The rollers 112 cause the substrate 110 to pass and engage the ITM 106 or, where present, the blanket 108 of the ITM. As the substrate 110 is brought into contact with the ITM 106, print agent from the ITM may be transferred onto the substrate in the form of the intended image. The print agent transferred onto the substrate may be fixed, for example by the application of heat and/or pressure.

The web substrate 110 may be guided and/or fed into the apparatus 100 by a web guide 118. The web guide 118 may serve to guide the web substrate 110 such that the web substrate is in an intended position as it passes through the apparatus 100 via the rollers 112. The web guide 118 may serve to advance the web substrate (e.g. in the direction of the arrows in FIG. 1) by an intended amount, such that images are transferred onto the web substrate at positions having indented spaces between them. The web guide 118 may adjust the lateral position of the web substrate 110 (e.g. in a direction perpendicular to the arrows in FIG. 1, in the plane of the web substrate). In some examples, the web guide 128 may guide the web substrate 110 such that the substrate is central with respect to a width of the rollers 112 and/or the ITM 106. As discussed below, the web guide 118 may guide operate to move the substrate 110 laterally with respect to the width of the rollers (i.e. lateral to the feed direction of the substrate).

The print apparatus 100 may further include a processor 120 for controlling components in the print apparatus 100. In some examples, the processor 120 may be operatively connected to the web guide 118. The processor 120 may control the web guide 118 to adjust a lateral position of the web substrate 110 based on image data representing the images to be printed. The processor 120 may, in some examples, be operatively connected to print head, which may include a laser source used to create a latent image onto the imaging plate 102. The processor 120 may control the print head or the laser source such that latent image to be formed on the imaging plate 102 is formed in a laterally-adjusted position. Consequently, the image to be transferred from the image plate to the ITM 106 is in a laterally-adjusted position. The processor 120 may, in some examples, control other components of the print apparatus 100.

Figure 2:
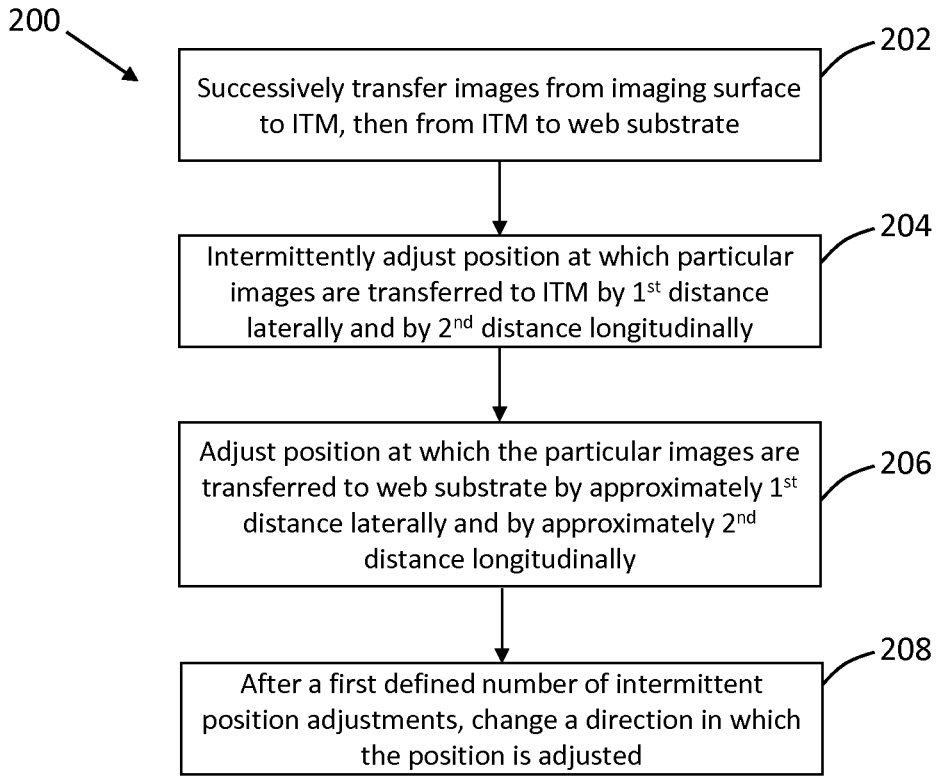
FIG. 2 is a flowchart of an example of a method of printing.

In some examples, the print apparatus 100 may be used to print multiple representations of an image on the web substrate 110. To reduce the number of times that the same image is transferred onto the ITM 106 in the same place, components of the print apparatus 100 may cause the position at which the image is transferred onto the ITM to be changed intermittently. FIG. 2 is a flowchart of an example method 200 for operating a print apparatus. The method 200 comprises, at block 202, successively transferring a series of images from an imaging surface 102 (e.g. an imaging plate)

to an intermediate transfer member, ITM 106, then from the ITM to positions on a web substrate 110. The ITM 106 may have a width (i.e. extending transverse to the feed direction of the substrate) and a length (i.e. extending around the ITM). In some examples, the imaging surface 102 and the ITM 106 comprise rollers having a substantially cylindrical shape. The print blanket 108 around the ITM 106 may have a longer axis (extending around the ITM) and a shorter axis (extending across the width of the ITM). In this context, a direction along the width of the roller may be referred to as being transverse or lateral to the feed direction. A direction along the longer axis of the print blanket 108, or around the ITM 106, may be referred to as being in the feed direction, or longitudinal.

The series of images to be transferred from the imaging surface 102 to the ITM 106 and, then, to the web substrate 110 may comprise a plurality of images that are substantially the same. The series of images may repeat at positions along the length of the web substrate. The distance between the start of adjacent images to be printed (or between any particular point common to all of the images) may be referred to as the repeat length. Thus, the repeat length may be controlled by controlling (e.g. increasing or decreasing) the gap between adjacent images transferred onto the imaging surface 102 and the ITM 106.

The method 200 may further comprise, at block 204, intermittently adjusting a position at which particular images are transferred to the ITM 106 by a first defined distance laterally across the ITM and by a second defined distance longitudinally with respect to the ITM. By "intermittent", it is meant that the position at which the images are transferred is not changed each time an image of the series of images is transferred; rather, a subset of the series of images may be printed in a particular position on the ITM before the position is adjusted. For example, the position on the ITM at which the images are to be transferred may be changed every other image, or after a particular number of images (e.g. five) have been transferred to the ITM in a particular position. When the image position on the ITM is to be changed, the position is adjusted both laterally and longitudinally.

At block 206, the method 200 may further comprise adjusting a position at which the particular images are transferred to the web substrate 110 by approximately the first defined distance laterally relative to the ITM 106 and by approximately the second defined distance longitudinally relative to the ITM. The position at which the images are transferred onto the web substrate may be changed by moving the web substrate by an amount, and in a direction, corresponding to the image position adjustment on the ITM 106. In other words, when the image position on the ITM 106 is changed, a commensurate change in the position of the web substrate 110 is also made. In this way, the change in position of the images on the ITM 106 will not be evident on the web substrate 110. Thus, all of the images in the series of images should appear in relatively the same position on the web substrate, even though the images are being transferred onto the ITM in different positions. The movement of the web substrate laterally (e.g. from side to side) may be effected by the web guide 118.

In some examples, the movement of the image position on the ITM 106 and the movement of the image position on the web substrate 110 may be performed at times when images are not being printed (i.e. transferred) onto the ITM and the web substrate. For example, the image position adjustments may be made between the printing of adjacent images. In this way, the position adjustment is not noticeable in the image transferred to the ITM or the web substrate, as any adjustments are made at times when the images are not being transferred.

While, in some examples, the adjustment of the position of the images on the web substrate may be exactly the same as the adjustment of the position of the images on the ITM, in other examples, the adjustment may not be identical. However, by moving the image position incrementally by a small distance (e.g. 50 micrometres) each time, a small discrepancy between the movement of the image position on the ITM and the image position on the web substrate is unlikely to be detectable to a user.

The method 200 may further comprise, at block 208, after a first defined number of intermittent position adjustments, changing a direction in which the position is adjusted. Such a position adjustment is discussed below with reference to an example shown in FIG. 3. Thus, for the first defined number of position adjustments, the image position may be moved in a first direction, for example in a line. After the first defined number of position adjustments, the direction in which the position is adjusted is changed, such that, thereafter, the image position is adjusted in a different direction. In some examples, the first defined number may comprise eighty. Thus, after the position of the images on the ITM has been adjusted eighty times in a first direction, the adjustment direction may be changed such that the position of the images is adjusted in a second direction. The position adjustments may continue in the second direction for a second defined number of times (for example, 20, 40, 60, 80 or 100 times) before the adjustment direction may be changed such that the position of the images is adjusted in a third direction, and so on. In this way, the same image is not transferred into the same position on the ITM more than an intended number of times.

In some examples, adjusting the positions at which the particular images are transferred to the ITM and to the web substrate comprises moving the positions along a path. Thus, the position at which the particular images are to be transferred onto the ITM may be moved in a closed path, such as a circle or a polygon, such that, after a finite number direction changes and position movements, the image may be transferred onto the ITM in its original position. In other words, a first image of the series of images may be transferred to the ITM in a first position. After a second defined number of position adjustments, an image to be transferred is transferred to the ITM in the first position. In some examples, the second defined number of positions may be the same as the first defined number discussed above.

Figure 3:
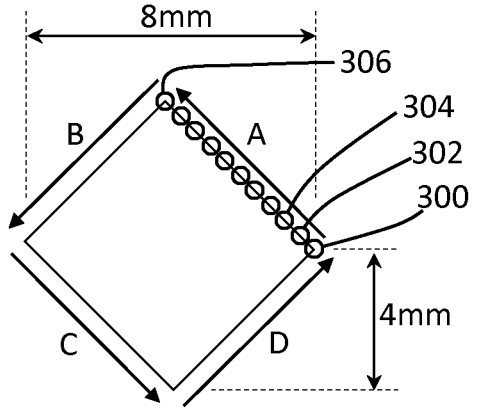
FIG. 3 is an illustration of an example of an image position adjustment that may be made.

FIG. 3 shows an example of how the position of an image may be adjusted in accordance with some examples. An image may first be transferred onto the ITM at position 300. In this example, the circle 300 indicates a position of a corner of an image to be transferred. After a defined number of times (for example, five) that the image is transferred at position 300, the position is adjusted both laterally and longitudinally on the ITM, for example in a direction indicated by arrow A, into a new position 302. The distance by which the image position is adjusted may be selected by a user, or programmed into the print apparatus. In some examples, the position may be moved by 50 micrometres laterally and 50 micrometres longitudinally. In other examples, the position of the image may be moved by a different amount. For example, the first defined distance (e.g. the lateral movement) and/or the second defined distance (e.g. the longitudinal movement) may comprise a distance of between 10 micrometres and 100 micrometres.

Once the image has been transferred onto the ITM at position 302 a defined number of times (for example, five), the position is adjusted again, both laterally and longitudinally on the ITM in the direction of arrow A, into a new position 304. Movement of the position may continue in the direction of arrow A for a defined duration, for a defined distance, or for a defined number of adjustments, until the image is transferred into the ITM at a position 306. While eleven positions are shown along the line in FIG. 3 for clarity, the image position may be adjusted a smaller or greater number of times. In some examples, the image position may be adjusted in a particular direction until the image position has moved 4 millimetres laterally, and 4 millimetres longitudinally, as indicated in FIG. 3. Thus, in the example where the position is moved 50 micrometres laterally and 50 micrometres longitudinally, the image position may be adjusted eighty times in the direction of arrow A, resulting in total movement of 4 mm laterally and 4 mm longitudinally.

Once the image has been transferred onto the ITM at position 306 a defined number of times (for example, five), the position is adjusted again. This time, the direction of adjustment is changed, such that the image position is moved in the direction of arrow B. The image position may be adjusted in the direction of arrow B for a defined number of times (eighty, in this example) and the direction of adjustment may be changed again, such that the image position is moved in the direction of arrow C. After a defined number (e.g. eighty) of adjustments, the direction of adjustment may be changed again, such that the image position is moved in the direction of arrow D. After a defined number (e.g. eighty) of adjustments in the direction of arrow D, the image position will be back at position 300. In this way, the image, in this example, may be transferred onto the ITM around 1600 times before it is returned to its original position on the ITM. In this example, the image position is moved along a path in the shape of a rhombus having a height and width of 8 mm.

In other examples, the image position may be moved by a different total amount laterally and longitudinally (e.g. more or less than 4 mm in both directions) before the direction of adjustment is changed. The amount by which the image position is moved may depend on the movement tolerance on the web substrate. For example, if the image to be printed is at its maximum format (i.e. the image is at its largest possible size on the substrate), then it may not be possible to adjust the position of the image on the ITM and/or it may not be possible to adjust the position of the web substrate relative to the ITM. If the image to be transferred onto the web substrate is significantly smaller than its maximum possible format (e.g. small relative to the printable area on the web substrate), then the image position may be adjusted by a greater extent, for example by a greater distance laterally and longitudinally.

The path along which the image position is moved may be selected based on parameters (e.g. size and shape) of the image to be transferred or printed. In some examples, the path may comprise a closed loop or shape. The image position may be moved along a path in a polygonal shape, such as a circle, an oval, a triangle, a square, a pentagon, a hexagon, and so on. In some examples, such as the example shown in FIG. 3, the path may comprise or form a rhombus shape.

The number of times an image is printed in a particular position (e.g. 302, 304, 306) before the position is adjusted and/or the distance by which the position is adjusted may be selected based, for example, on parameters (e.g. size and shape) of the image to be transferred or printed, on the amount, type, colour and/or quality of print agent (e.g. ink) to be transferred, and/or on the number of images to be printed in total during a print job. In other words, a repetition rate of the intermittent position adjustments, of the first defined distance and/or of the second defined distance may be based on the nature and the number of images in the series of images.

In examples discussed above, a position of the image is adjusted after five images have been transferred onto the ITM at a particular position. In other examples, the position may be adjusted after a different number of images have been transferred at a particular position. For example, intermittently adjusting a position may comprise periodically adjusting a position of an image at a repetition rate of between one image in every five images and one image in every twenty images.

Figure 4:
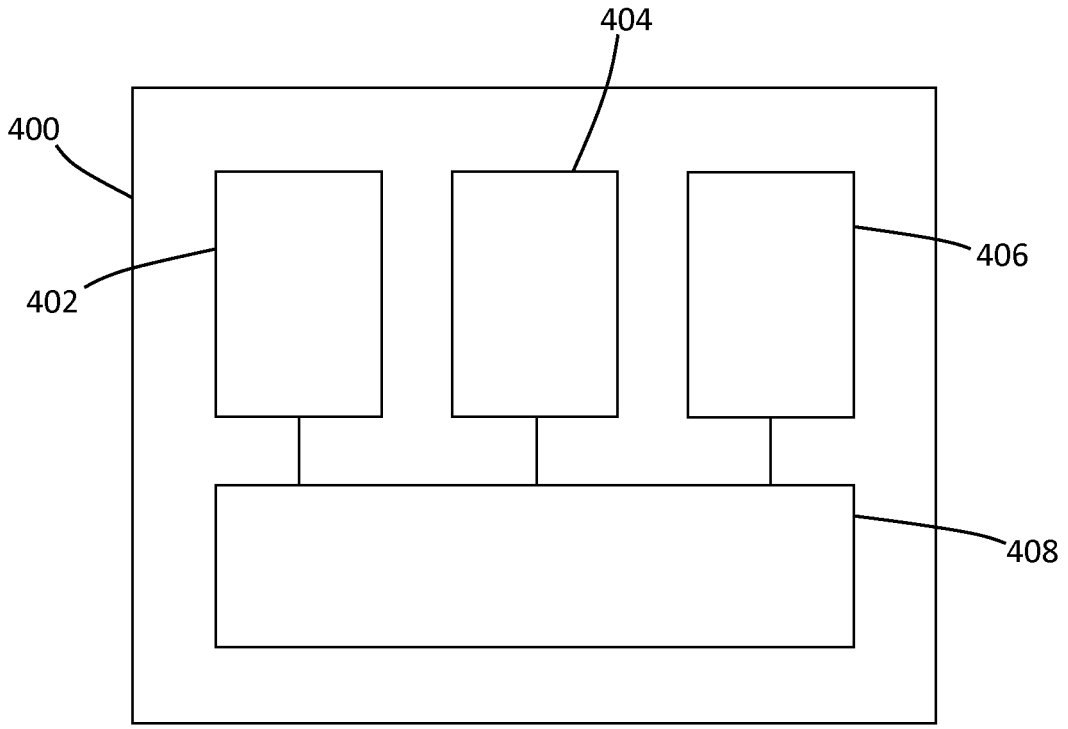
FIG. 4 is a simplified schematic of a further example of print apparatus.

FIG. 4 shows, schematically, a print apparatus 400. The print apparatus 400 may be used to implement the method 200 discussed above. The print apparatus 400 comprises an image plate 402 to receive images to be printed. The image plate 402 may, in some examples, comprise a photo imaging plate (PIP), such as the PIP 102 discussed above. The print apparatus 400 may comprise an intermediate transfer member (ITM) 404 to receive images from the image plate 402. The ITM 404 may, in some examples, include a print blanket. The print apparatus 400 may comprise a web guide 406 to guide a printable substrate (e.g. web substrate 110) to the ITM 404 such that images can be transferred from the ITM onto the printable substrate. The print apparatus 400 may comprise processing circuitry 408. The processing circuitry 408 may, in some examples, be operably connected to the image plate 402, the ITM 404 and/or the web guide 406.

The processing circuitry 408 may be operable to intermittently modify a position at which particular images are transferred onto the ITM 404 by a first defined distance laterally across the ITM and by a second defined distance longitudinally with respect to the ITM. The processing circuitry 408 may modify a position at which the particular images are transferred onto the web substrate by approximately the first defined distance laterally relative to the ITM 404 and by approximately the second defined distance longitudinally relative to the ITM. The processing circuitry 408 may, after a defined number of intermittent position modifications, change a direction in which the position is modified. In some examples, the processing circuitry 408 may be remote from the print apparatus 400. For example, the processing circuitry 408 may form part of a remote computing device or server operably connected to the print apparatus 400.

In some examples, the processing circuitry 408 may intermittently modify the position at which the particular images are transferred onto the ITM 404 by modifying a position at which the particular images are transferred onto the image plate 402. In some examples, images (such as latent images) may be transferred onto the image plate 402 using a laser beam from a laser source. The laser source may direct the laser beam to form the image onto the image plate 402, and may adjust the position of the image on the image plate 402 by directing the laser beam in a different position.

The processing circuitry 408 may, in some examples, modify the lateral position at which the particular images are transferred onto the printable substrate by operating the web guide 406 to adjust the lateral position of the printable substrate by the second defined distance. In this way, the image position on the ITM 404 is moved by the same amount as the printable substrate and, therefore, the relative position of image on the printable substrate does not appear to have changed, even though the image has be transferred onto the ITM in a different position.

In some examples, the processing circuitry 408 may modify the longitudinal position at which the particular images are transferred onto the ITM by adjusting a repeat length of images to be transferred onto the image plate 402. For example, reducing the repeat length would cause the space between adjacent images on the ITM to be reduced; increasing the repeat length would cause the space between adjacent images on the ITM to be increased. Thus, incremental changes to the repeat length may be used to change the longitudinal position of the images on the ITM and, therefore, on the web substrate. In some examples, the repeat length may be increase by introducing a partial null cycle of the image plate 402. In examples where the imaging plate comprises a photo imaging plate, the images may be transferred onto the ITM by the rotation of the image plate relative to the ITM. A null cycle may involve the image plate rotating at least partially without transferring an image onto the ITM. While the image plate 402 is performing a partial null cycle, the printable substrate may still advance and, as a result, the position at which the image will be transferred onto the printable substrate may be adjusted longitudinally as a result of the partial null cycle.

The processing circuitry 408 may, in some examples, modify the longitudinal position at which the particular images are transferred onto the printable substrate by modifying an image repeat length. The image repeat length is the distance by which the printable substrate is advanced after transferring a first image onto the substrate, before a subsequent image is transferred onto the substrate. By adjusting the image repeat length, it may be possible to accurately adjust, longitudinally, the position at which subsequent images are transferred onto the substrate. The image repeat length may be controlled and/or adjusted by the web guide.

Figure 5:
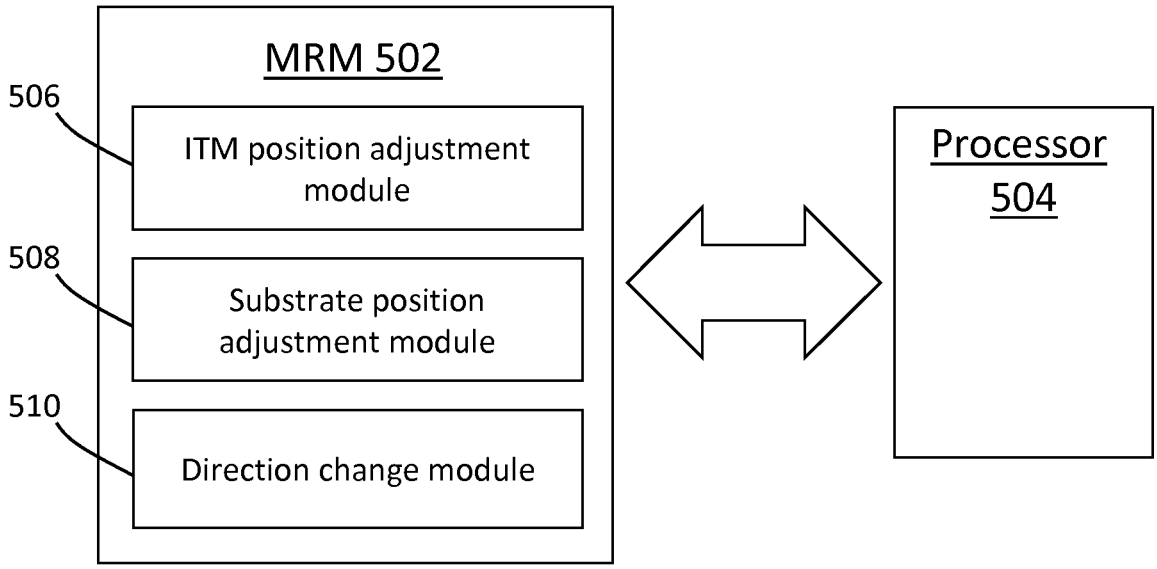
FIG. 5 is a simplified schematic of a machine-readable medium and a processor.

FIG. 5 shows a simplified schematic of a machine-readable medium 502 and a processor 504. The processor 504 may comprise the processing circuitry 408 and/or the processor 120 discussed above. The machine-readable medium 502 may interact with the processor 504 via a wired or wireless communication link.

The machine-readable medium (MRM) 502 may comprise instructions which, when executed by a processor, such as the processor 504, cause the processor to intermittently modify a position at which particular images are transferred onto the ITM by a first defined distance laterally across the ITM and by a second defined distance longitudinally with respect to the ITM. In some examples, the intermittent position modification may be performed by an ITM position adjustment module 506 of the MRM 502.

The MRM 502 may comprise instructions which, when executed by a processor, cause the processor to modify a position at which the particular images are transferred onto the printable substrate by approximately the first defined distance laterally relative to the ITM and by approximately the second defined distance longitudinally relative to the ITM. In some examples, the position modification may be performed by a substrate position adjustment module 508 of the MRM 502.

The MRM 502 may comprise instructions which, when executed by a processor, cause the processor to change a direction in which the position is modified after a defined number of intermittent position modifications. The change of direction may, in some examples, be performed by a direction change module 510 of the MRM 502.

The MRM 502 may form part of a print apparatus, such as the print apparatus 100, 400. In some examples, the processor 504 may form part of the print apparatus 100, 400 while, in other examples, the processor may be remote from the print apparatus, and communicate with the MRM 502 and/or other components of the print apparatus remotely.

In some examples, the MRM 502 may comprise instructions which, when executed by a processor, cause the processor to determine the defined number of intermittent position adjustments, the repeat rate of the position adjustment, the first defined distance and/or the second defined distance based on image data describing the series of images. In this way, parameters of the position adjustments may be determined prior to commencing the printing process, using the print job data. Determining the parameters of the image position adjustments prior to commencing the printing process may improve the efficiency and/or the productivity of the print apparatus.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method, comprising:

successively transferring a series of images from an imaging surface to an intermediate transfer member (ITM) then from the ITM to positions on a web substrate;

intermittently adjusting a position at which a corner of particular images are transferred to the ITM by a first defined distance laterally across the ITM and by a second defined distance longitudinally with respect to the ITM; and adjusting a position at which the corner of the particular images are transferred to the web substrate by approximately the first defined distance laterally relative to the ITM and by approximately the second defined distance longitudinally relative to the ITM;

after a first defined number of intermittent position adjustments, changing a direction in which the position is adjusted such that the corner of the particular images are adjusted along a closed loop path that is smaller than a size of the web substrate.

2. A method according to claim 1, wherein adjusting the positions at which the particular images are transferred to the ITM and to the web substrate comprises moving the positions along the closed loop path.

3. A method according to claim 2, wherein the closed loop path comprises a rhombus shape.

4. A method according to claim 1, wherein the first defined distance and the second defined distance comprises a distance of between 10 micrometres and 100 micrometres.

5. A method according to claim 1, wherein a repetition rate of the intermittent position adjustments of the first defined distance and the second defined distance is based on a nature and a quantity of images in the series of images.

6. A method according to claim 1, wherein intermittently adjusting a position comprises periodically adjusting a position of an image at a repetition rate of between one image in every five images and one image in every twenty images.

7. A method according to claim 1, wherein a first image of the series of images is transferred to the ITM in a first position; and wherein, an image to be transferred after a second defined number of position adjustments, is transferred to the ITM in the first position.

8. A print apparatus, comprising:

an image plate to receive images to be printed;

an intermediate transfer member, ITM, to receive images from the image plate;

a web guide to guide a printable substrate to the ITM such that images can be transferred from the ITM onto the printable substrate; and processing circuitry to:

intermittently modify a position at which a corner of particular images are transferred onto the ITM by a first defined distance laterally across the ITM and by a second defined distance longitudinally with respect to the ITM;

modify a position at which the corner of the particular images are transferred onto the printable substrate by approximately the first defined distance laterally relative to the ITM and by approximately the second defined distance longitudinally relative to the ITM such that the corner of the particular images are adjusted along a closed loop path that is smaller than a size of the printable substrate; and after a defined number of intermittent position modifications, change a direction in which the position is modified.

9. A print apparatus according to claim 8, wherein the processing circuitry is to intermittently modify the position at which the corner of the particular images are transferred onto the ITM by modifying a position at which the corner of the particular images are transferred onto the image plate.

10. A print apparatus according to claim 8, wherein the processing circuitry is to modify the lateral position at which the corner of the particular images are transferred onto the printable substrate by operating the web guide to adjust the lateral position of the corner of the printable substrate by the second defined distance.

11. A print apparatus according to claim 8, wherein the processing circuitry is to modify the longitudinal position at which the corner of the particular images are transferred onto the ITM by adjusting a repeat length associated with the corner of the particular images.

12. A print apparatus according to claim 8, wherein the processing circuitry is to modify the longitudinal position at which the corner of the particular images are transferred onto the printable substrate by modifying an image repeat length.

13. A machine-readable medium comprising instructions which, when executed by a processor, cause the processor to:

intermittently adjust a position at which a corner of particular images of a series of images are transferred to an intermediate transfer member, ITM, from an imaging surface, the position adjustment comprising a displacement by a first defined distance laterally across the ITM and a displacement by a second defined distance longitudinally with respect to the ITM;

adjust a position at which the corner of the particular images are transferred to a web substrate from the ITM, the position adjustment comprising a displacement by approximately the first defined distance on the web substrate laterally relative to the ITM and a displacement by approximately the second defined distance on the web substrate longitudinally relative to the ITM such that the corner of the particular images are adjusted along a closed loop path that is smaller than a size of the web substrate; and after a defined number of intermittent position adjustments, change a direction in which the position is adjusted.

14. A machine-readable medium according to claim 13, comprising instructions which, when executed by a processor, cause the processor to:

determine the defined number of intermittent position adjustments, the repeat rate of the position adjustment, the first defined distance and the second defined distance based on image data describing the series of images.

* * * * *